US006926626B2

(12) United States Patent
Scarpa, III

(10) Patent No.: US 6,926,626 B2
(45) Date of Patent: Aug. 9, 2005

(54) COVER HOUSING FOR TENNIS NET SUPPORT POST

(76) Inventor: Edward A. Scarpa, III, 2102 Atlantic Ave., Sullivan's Island, SC (US) 29482

( * ) Notice: Subject to any disclaimer, the term of this patent is extended or adjusted under 35 U.S.C. 154(b) by 0 days.

(21) Appl. No.: 10/690,645

(22) Filed: Oct. 23, 2003

(65) Prior Publication Data

US 2005/0090338 A1 Apr. 28, 2005

(51) Int. Cl.[7] ..... A63B 61/02
(52) U.S. Cl. ..... 473/492; 248/523
(58) Field of Search ..... 473/492–494; 52/40, 721.4; 248/514, 523, 524, 525, 526, 527

(56) References Cited

U.S. PATENT DOCUMENTS 277,551 A * 5/1883 Cunningham ..... 473/492
3,195,898 A * 7/1965 Respini ..... 473/197
4,310,989 A * 1/1982 Shannon, Jr. ..... 47/40.5
5,002,252 A * 3/1991 Setala et al. ..... 248/533
5,176,344 A * 1/1993 Eberhard ..... 248/156
5,291,709 A * 3/1994 Vranjesevic ..... 52/297
5,482,245 A * 1/1996 Graves ..... 248/523
6,260,314 B1 * 7/2001 Church et al. ..... 52/170
6,299,124 B1 * 10/2001 Reback et al. ..... 248/519
6,419,201 B1 * 7/2002 Hughes et al. ..... 248/514

* cited by examiner

*Primary Examiner*—Raleigh W. Chiu
(74) *Attorney, Agent, or Firm*—Dykema Gossett PLLC

(57) ABSTRACT

A cover housing for a tennis net support post includes a casing which defines an interior chamber and can, be positioned over the support post, and a cap which fits on top of the casing, the casing including upper and lower positioning means for contacting the support post therein to fix the casing in position relative to the support post and adjust its orientation, e.g. to vertical. The cap includes a slot through which a tennis net cable can pass into the interior chamber of the casing. An embodiment of the housing embodiment for covering a support post having a cable winch mounted thereon includes a vertical slot in its outer side to enable the tennis net cable to pass to the cable winch (remounted on its outer side) after having passed over the upper end of the support post therein. The positioning means can include a mounting element that extends into the side of the casing and a screw element that extends through the mounting element into the interior chamber of the casing. Eye hooks can be positioned along the inner side of the casing for a fastening cord that also extends-through eyelets in an adjacent end of the tennis net to tighten the net towards the cover housing.

18 Claims, 4 Drawing Sheets

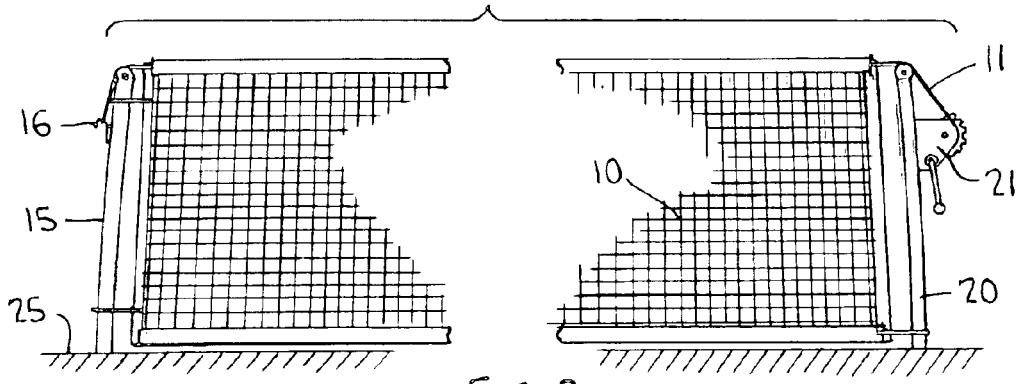
FIG. 3
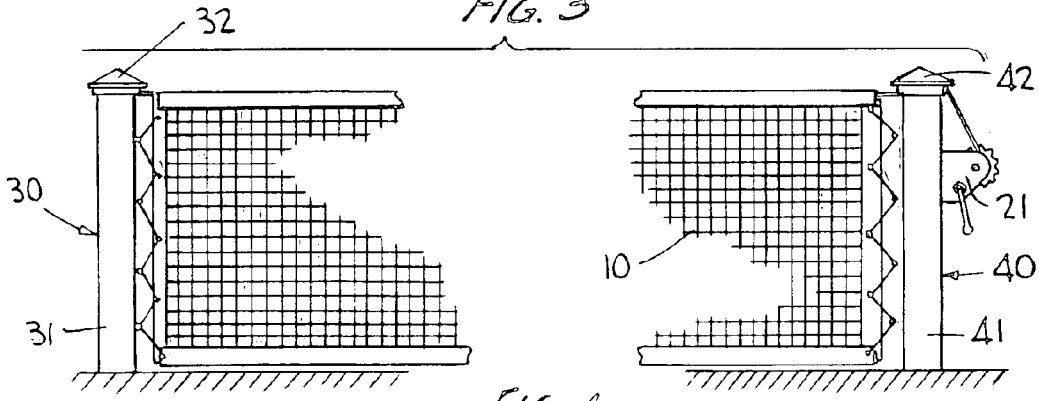
FIG. 2
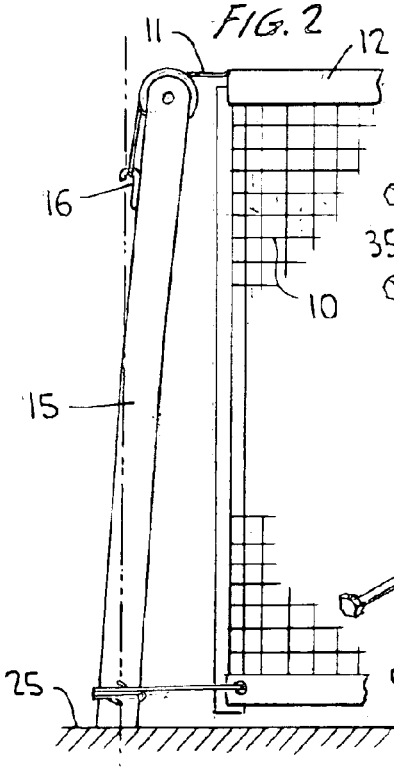
FIG. 4
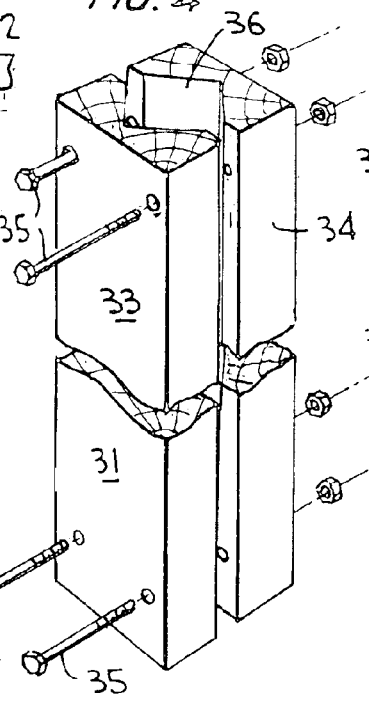
FIG. 5
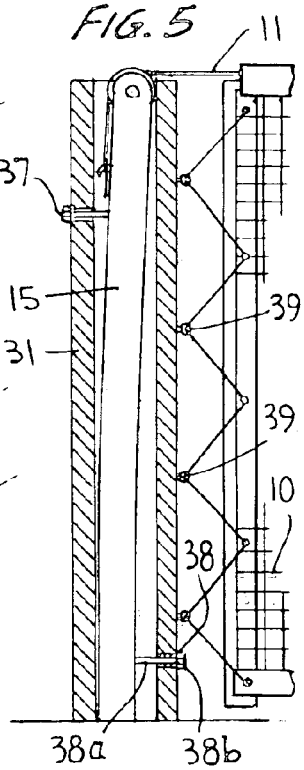

COVER HOUSING FOR TENNIS NET SUPPORT POST

BACKGROUND OF THE INVENTION

1. Field of the Invention

The present invention relates to the sport of tennis, and in particular to the appearance of the court on which the game is played.

2. The Prior Art

The game of tennis is played on a court which includes a flat surface marked off to provide a rectangular play area and a net which is suspended over the mid point of the play area by support posts located on opposite sides of the play area. The players must hit a tennis ball over the net and into appropriate zones in the play area. The support posts are usually made of steel tubes vertically positioned in the ground next to the play area, and they are often embedded in concrete. One of the support posts usually mounts a hook to which one end of a net cable is attached (the net cable passes through a fabric sleeve that extends along the top edge of the net), and the other support post often mounts a hand-operated cable winch to which the other end of the net cable is attached (the cable winch can be either externally or internally mounted). Operation of the cable winch tightens the net cable to straighten the upper edge of the net, i.e., raise its middle area to the required height above the court surface.

The tension applied to the net cable can eventually cause the support posts to bend towards one another, thus presenting an unattractive appearance. This is of special concern for tennis courts used for match play where a true vertical positioning of the support posts is expected. And it is almost impossible to correct the bend in a support post without replacing it entirely, which is both time consuming and costly.

A need exists for overcoming the unattractive appearance of tennis court support posts, and in particular those which have become bent and out of vertical, while avoiding the need for their replacement. I have invented a cover housing which achieves this object.

SUMMARY OF THE INVENTION

According to this invention, a cover housing is provided for a net support post which includes a casing that provides an internal chamber sufficiently large to contain the support post, and a removable cap for the upper end of the casing, the casing can be lifted over the support post and lowered thereover until its rests on the ground at the base of the support post, and the cap can be positioned thereon. Positioning means are provided along the length of the casing for contacting the support post therein so as to fixedly position the casing relative to the support post and adjust its orientation, e.g., to vertical. The cap which fits thereon can include a slot which enables the net cable to pass into the cover housing and over the top of the support post in the casing so that the stress of supporting the net cable remains on the support post.

In an embodiment of cover housing for placement over a tennis net support post which mounts a hook for attachment of the net cable, the internal chamber therein is sufficiently large to accommodate both the support post the hook thereon.

In an embodiment of the cover housing for placement over a tennis net support post to which a cable winch is externally mounted, the cable winch is detached from the support post and attached to the outer side of the casing of the cover housing. In this embodiment of cover housing the casing includes a vertical slot at its upper end to enable the net cable, after passing over the support post therein, to extend downwardly to the cable winch mounted on its outer side.

In an embodiment of the cover housing for placement over a tennis net support post which contains an internal winch, the casing fits over the post and it includes a vertical slot at its upper end to enable a coupling of a hand crank to extend into the internal chamber therein to connect with an operating shank of the winch.

The cover housing of the invention preferably includes eye hooks spaced along the length of its casing for threading therethrough of a fastening cord that also passes through eyelets in the adjacent end of the tennis net to tighten the net towards the cover housing.

The invention will be better understood by reference to the attached drawings, taking in, conjunction with the following discussion.

BRIEF DESCRIPTION OF THE DRAWINGS

In the drawings,

FIG. 1 shows a tennis net mounted to and between two conventional support posts which are bent out of vertical, the left support post including a hook on its outer side for attachment of the left end of the net cable and the right support post including an external cable winch on its outer side for attachment of the right end of the net cable;

FIG. 2 shows, an enlarged scale, the left support post and the adjacent end portion of the tennis net;

FIG. 3 shows the tennis net of FIG. 1 mounted to and between two cover housings according to the present invention, the left cover housing being positioned over the left support post of FIG. 1 and the right cover housing being positioned over the right support post, with the external cable winch relocated onto an outer side of the casing of the right cover housing;

FIG. 4 shows a perspective view of the casing of the left cover housing of FIG. 3;

FIG. 5 illustrates the positioning of the left support post within the casing of the left cover housing of FIG. 3;

DETAILED DESCRIPTION OF THE PREFERRED EMBODIMENTS

Figure 11:
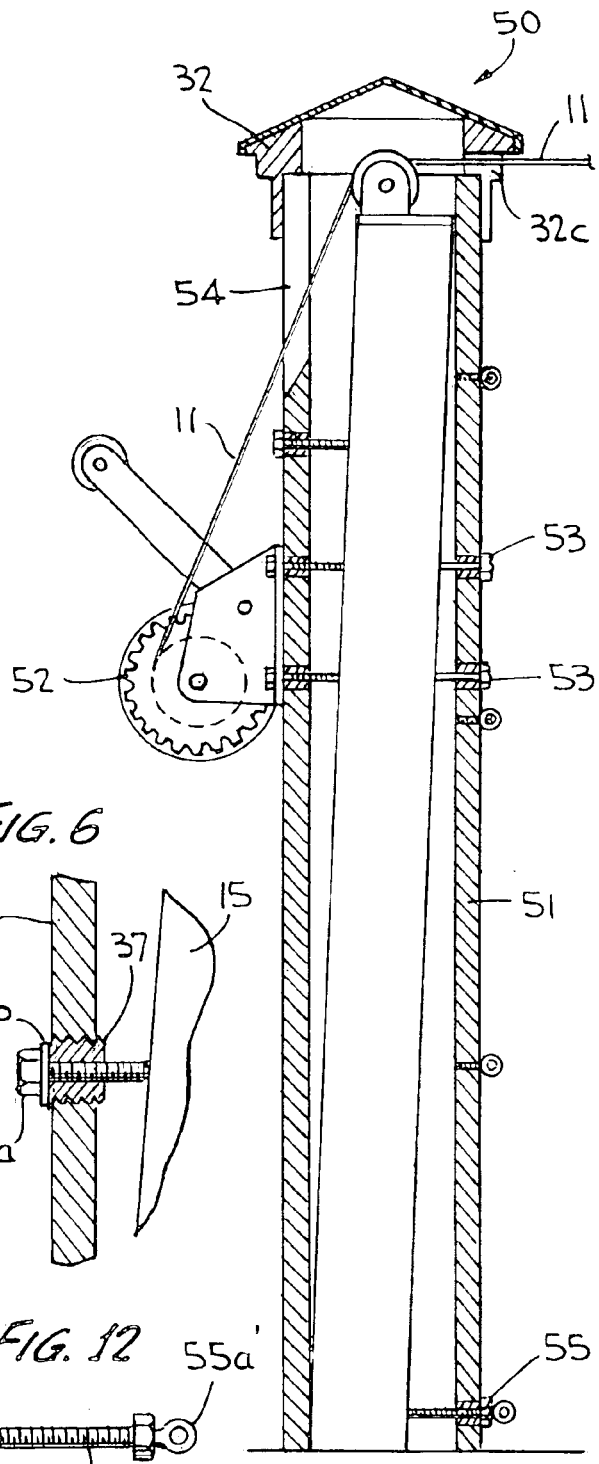
FIG. 11 shows a cross section through another embodiment of cover housing according to the invention.

In the following description the terms "inner" and "outer" will relate to the positioning of the described element or feature relative to the area between tennis net support poles, i.e., the play area of the court.

FIG. 1 depicts a conventional tennis net 10 mounted to and between two conventional support posts 15 and 20, the support post 15 mounting a hook 16 for attachment of one end of cable 11 of the tennis net and the support post 20 mounting an external hand-operated cable winch 21 to which the second end of cable 11 is engaged. The cable 11 extends through a sleeve 12 at the upper edge of net 10 (see FIG. 2), and the cable winch 21 can be hand operated to tighten the cable 11 so as to remove slack in the upper edge of net 10 and raise its middle area to the proper level. The lower ends of support posts 15 and 20 are fixedly embedded in the surface 25 of the tennis court, e.g., concrete, and although they are usually made of tubular steel, over time they can bend out of vertical and towards one another, resulting in an unattractive appearance.

FIG. 3 depicts the tennis net 10 mounted between a cover housing 30 and a cover housing 40 of the present invention, these cover housings having been respectively positioned over the support posts 15 and 20 in FIG. 1 (after detachment of the cable winch 21 from the support post 20 and reattachment to the outer side of the casing of the cover housing 40). The cover housing 30 includes a casing 31 and a removable cap 32, and the cover housing 40 includes a casing 41 and a removable cap 42.

Figure 6:
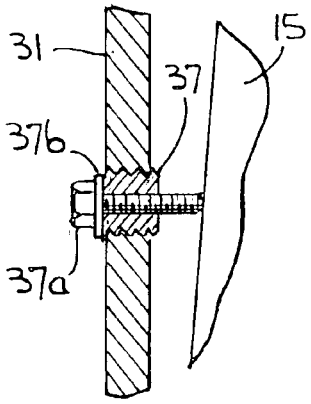
FIG. 6 shows, on an enlarged scale, the upper positioning device in the casing of the left cover housing of FIG. 5.

As seen in FIG. 4, the casing 31 is provided by an outer elongated profile 33 and an inner elongated profile 34, the two profiles being connected together by bolts 35 (other means can be used to connect the profiles together such as glue, screws, nails, straps, etc.). The two profiles 33 and 34, when connected together, define a generally rectangular outer configuration and provide a generally diamond-shaped interior chamber 36 which extends along the vertical length of the casing. The support post 15 extends within this interior chamber (see FIG. 5). The outer elongated profile 33 includes an upper positioning device 37 near its upper end (see FIG. 6) which includes, a screw element 37*a* (see FIG. 6) that threadingly extends through a mounting element 37*b*, such as a threaded insert or a T-nut extending into the profile, to contact an upper end of the support post 15. The inner elongated profile 34 includes a lower positioning device 38 near its lower end that includes a screw element 38*a* that threadingly extends through a mounting element 38*b*, such as a threaded insert on a T-nut, to contact a lower end of the support post 15. Adjustment of screws 37 and 38 enables the casing 31 to be fixedly positioned relative the support post 15 and adjusted, e.g., so as to be vertically oriented. The inner profile also includes vertically spaced eye hooks 39 for threading of a fastening cord 13 that extends through eyes in the adjacent end of net 10.

Figure 7:
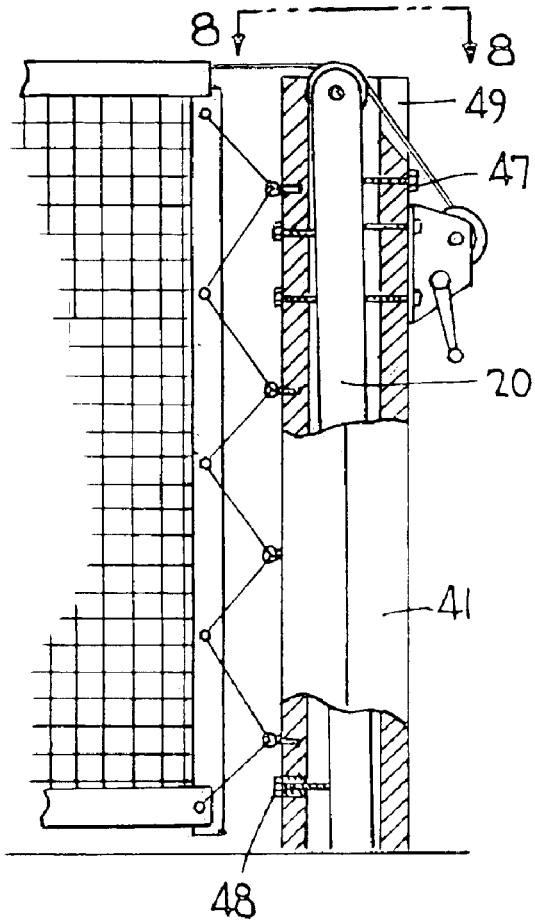
FIG. 7 illustrates the positioning of the right support post within the casing of the right cover housing of FIG. 3.
Figure 8:
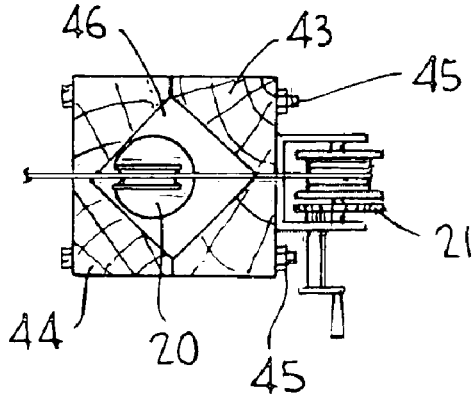
FIG. 8 shows a view of FIG. 7 as seen along line 8—8 therein.

FIGS. 7 and 8 show the casing 41, which is provided by an outer elongated profile 43 and an inner elongated profile 44 connected together by bolts 45. Likewise to casing 31, the profiles 43 and 44, when connected together, define a generally rectangular outer configuration and provide a generally diamond-shaped interior chamber 46. The support post 20 extends in the interior chamber 46 (see FIG. 8). The outer profile 43 includes an upper positioning device 47 that includes a screw element which threadingly extends through a mounting element such as threaded insert or a T-nut located near its upper end for engagement against an upper end of the support post 20. The inner elongated profile 44 includes a lower positioning device. 48 that includes a screw element which threadingly extends through a&threaded insert or a T-nut located near its lower end for engagement against the lower end of the support post 20. Adjustment of screws 47 and 48 enables the casing 41 to be fixedly positioned relative to the support post 20 and adjusted, e.g., so as to be vertically oriented. The outer profile includes a vertical slot 49 that extends downwardly from its upper end to enable the net cable ii to pass downwardly to the cable winch 21 after passing over the upper end of the support post 20.

Figure 9:
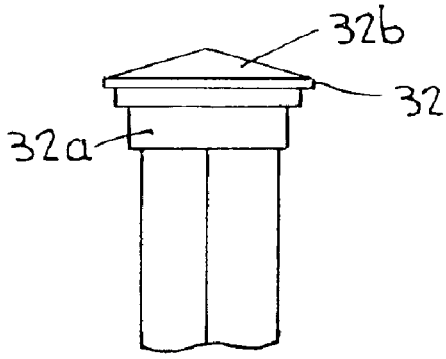
FIG. 9 shows, on an enlarged scale, the cap on the upper end of the casing of the left cover housing of FIG. 3.

FIG. 9 depicts the cap 32, which is seen to include a square base 32*a* that provides a square seat for positioning on the upper end of the casing 31 and a pyramidal top 33*b*. The base includes a vertical slot (see FIG. 11) for the net cable.

Figure 10:
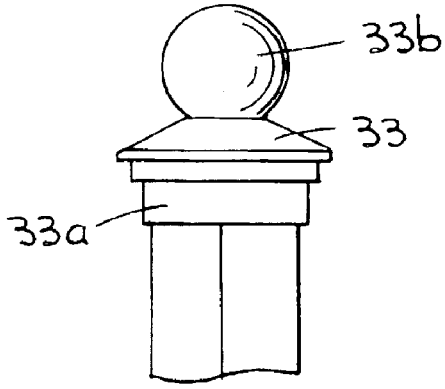
FIG. 10 shows an alternative embodiment of cap which can be positioned on the upper end of the casing.

FIG. 10 depicts an alternative embodiment of cap 33 which includes a square base 33*a* and a ball top 33*b*. It also includes a vertical slot (see FIG. 13) for the net cable.

FIG. 11 shows a cross section through an alternative cover housing 50 which includes a casing 51 (to which a cable winch 52 is attached by bolts 53) and a cap 32 as depicted in FIG. 9, the cap including a slot 32*c* for the tennis net cable 11 to pass therethrough. The casing has a vertical slot 54 at the upper end of its outer side for the net cable 11 to pass from the support post 30 therein to the cable winch 52. The inner side of the casing includes a lower positioning device 55 having a screw element 55*a* with a eye 55*a*' at its exposed end for threading therethrough of the fastening cord (not shown) attached to the adjacent end of the tennis net (not shown). The use of such a positioning device results in the need for fewer eye hooks along the length of the casing.

Figure 13:
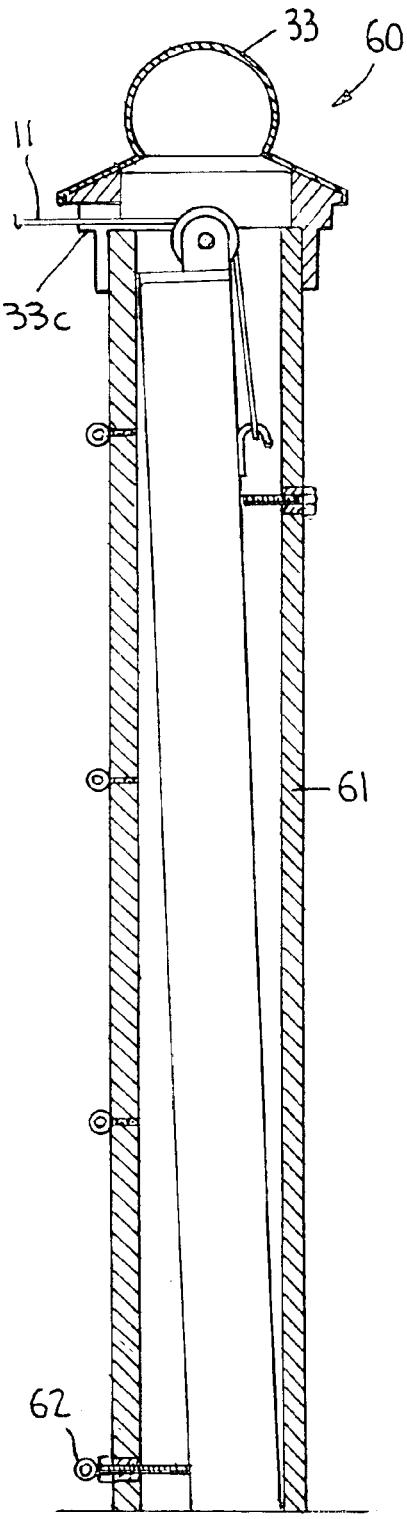
FIG. 13 shows a cross section through a further embodiment of cover housing according to the invention.
Figure 12:
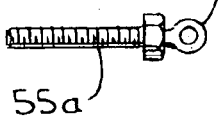
FIG. 12 shows the screw element of the lower positioning device in the post of the cover housing of FIG. 11.

FIG. 13 shows a cross section through a further cover housing 60 that includes a casing 61 and a cap 33 (with a cable slot 33*c*) as depicted in FIG. 10, the lower positioning device including a screw element with an eye at its exposed end as shown in FIG. 12.

Figure 14:
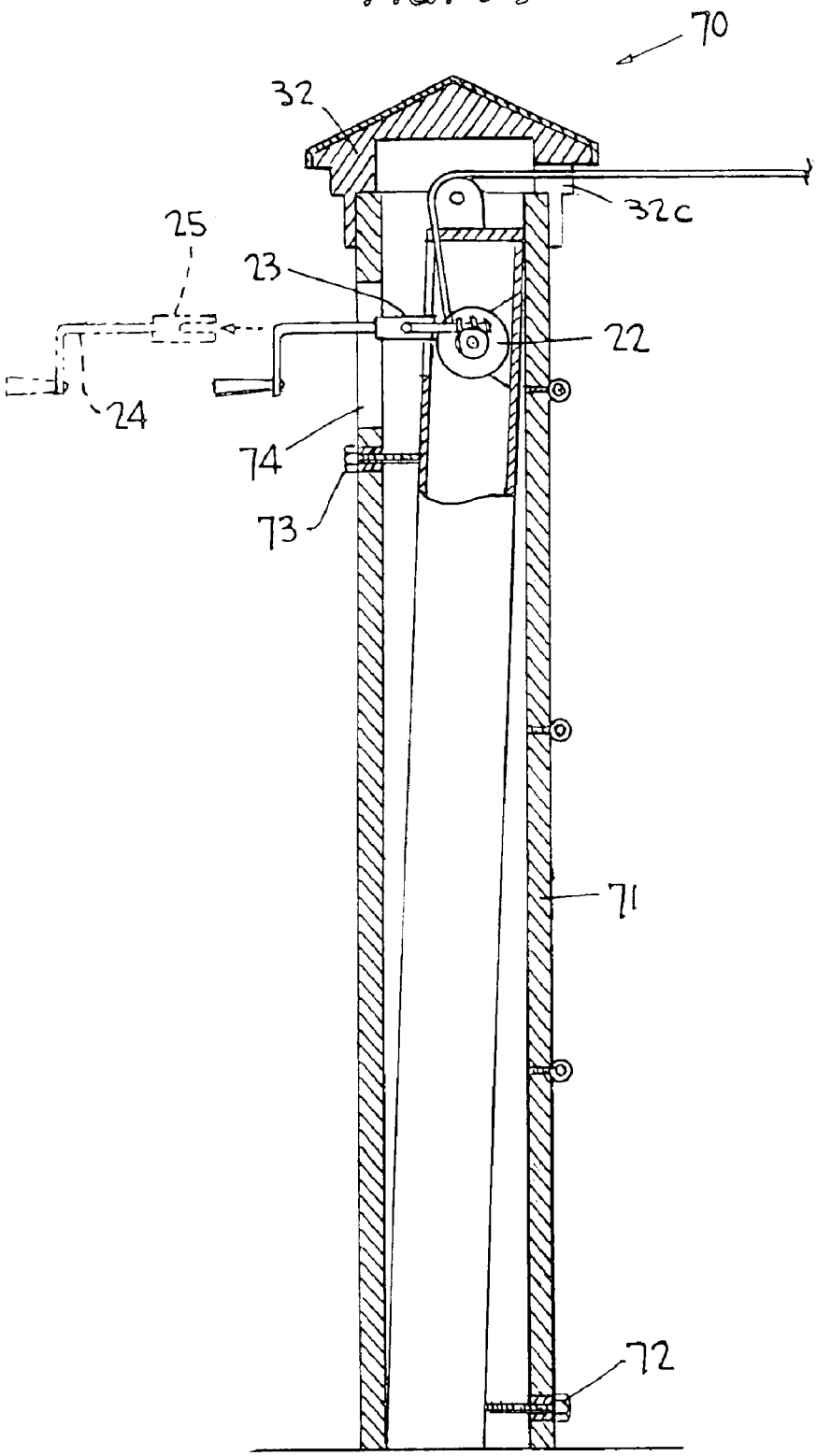
FIG. 14 shows a cross section through another embodiment of cover housing according to the invention.

FIG. 14 shows a cross section through another embodiment of cover housing 70 which includes a casing 71 and a cap 32 (with slot 32*c*) for covering a tennis net support post 16 having an internal winch 22. The inner side of the casing 71 includes a lower positioning device 72 and the outer side of the casing includes an upper positioning device 73 which are in accordance with the other embodiments. It also includes a slot 74 on its outer side to enable a coupling 25 of a hand crank 24 to pass into the internal chamber of the casing and engage a shank 23 of the winch 22.

Although various preferred embodiments of the invention have been shown and described, changes therein can be made and still fall within the scope of the invention. For example, the casing of the cover housing can be a one-piece structure which has been hollowed out to form the interior chamber, and it can have an outer cross section other than square and an interior chamber cross section other than diamond shaped. The casing of the cover housing can be made of wood, plastic, metal or any other suitable rigid and weather-resistant material.

I claim:

1. A cover housing for a tennis net support post, said cover housing comprising a casing that provides an internal chamber in which the tennis net support post can extend when the casing is lowered thereover, a removable cap that can be positioned over an upper end of the casing, and positioning means which extend through opposite sides of the casing for contact with the tennis net support post therein for fixedly positioning the casing relative to the support post and adjusting its orientation to vertical.

2. A cover housing according to claim 1, wherein said positioning means comprises an upper positioning means located near an upper end of said casing and a lower positioning means located near a lower end of said casing.

3. A cover housing according to claim 2, wherein said upper positioning means comprises a first mounting element that extends into said casing and first screw element which extends through said first mounting element into said internal chamber.

4. A cover housing according to claim 3, wherein said lower positioning means comprises a second mounting means which extends into said casing and a second screw element which extends through said second mounting means into said internal chamber.

5. A cover housing according to claim 4, wherein said casing includes a vertical slot in an upper end thereof.

6. A cover housing according to claim 5, including a cable winch mounted on said casing.

7. A cover housing according to claim 6, including a plurality of vertically spaced eye hooks mounted along said casing.

8. A cover housing according to claim 2, wherein said casing is made of wood.

9. A cover housing according to claim 1, wherein said casing includes first and second profiles connected together.

10. A cover housing according to claim 1, wherein said casing defined a generally square outer cross section and a generally diamond-shaped internal chamber.

11. A cover housing according to claim 1, wherein said cap includes a slot for a net cable.

12. A cover housing according to claim 11, wherein said cap includes a square base and a pyramidal top.

13. A cover housing according to claim 11, wherein said cap includes a square base and a ball top.

14. A combination of a support post for a net and a cover housing positioned over the support post, said cover housing comprising a casing that has an internal chamber in which the post extends, upper and lower positioning means on opposite sides of the casing for contact with the support post in the internal chamber, and a cap for covering an upper end of the casing.

15. A combination according to claim 14, wherein said support post includes a hook thereon for a tennis net cable.

16. A combination according to claim 14, wherein said support post includes an internal winch.

17. A combination according to claim 16, wherein said casing includes a vertical slot near an upper end thereof and including a hand crank with coupling which can extend through said vertical slot to engage a shank of said internal winch for operation thereof.

18. A combination according to claim 14, including a hand winch attached to an outer side of said casing.

* * * * *